US005566504A

United States Patent [19]

Pitel

[11] Patent Number: 5,566,504

[45] Date of Patent: Oct. 22, 1996

[54] COMBINATION DOOR GASKET AND SAFETY EDGE STRIP

[76] Inventor: John A. Pitel, 16 Hawthorne Pl., Dumas, Ark. 71639

[21] Appl. No.: 416,582

[22] Filed: Apr. 3, 1995

[51] Int. Cl.[6] ..... E05F 15/02

[52] U.S. Cl. ..... 49/28; 49/26; 49/27

[58] Field of Search ..... 49/26, 27, 28, 49/366; 403/397, 263

[56] References Cited

U.S. PATENT DOCUMENTS

| | | | |
|---|---|---|---|
| 2,221,216 | 6/1938 | Greegor et al. | 268/59 |
| 3,299,570 | 12/1964 | Radcliffe | 49/27 |
| 3,303,303 | 2/1967 | Miller | 49/27 |
| 4,051,336 | 8/1977 | Miller | 49/27 |
| 4,115,952 | 9/1978 | French | 49/26 |
| 4,301,621 | 11/1981 | Houweling | 49/27 |
| 4,349,710 | 9/1982 | Miller | 200/61.43 |
| 4,698,967 | 10/1987 | Langora | 49/27 |
| 5,023,418 | 6/1991 | Beckhausen | 200/511 |
| 5,027,552 | 7/1991 | Miller et al. | 49/27 |
| 5,079,417 | 1/1992 | Strand | 250/221 |
| 5,259,143 | 11/1993 | Mitchell et al. | 49/27 |
| 5,280,754 | 1/1994 | Flanagan et al. | 49/28 |
| 5,285,136 | 2/1994 | Duhame | 318/266 |
| 5,299,387 | 4/1994 | Miller et al. | 49/27 |
| 5,327,680 | 7/1994 | Miller | 49/27 |
| 5,399,851 | 3/1995 | Strand | 49/26 |
| 5,438,798 | 8/1995 | Plamper | 49/28 |

FOREIGN PATENT DOCUMENTS

| | | | |
|---|---|---|---|
| 2663363 | 12/1991 | France | 49/27 |
| 3107847 | 3/1981 | Germany | 49/27 |
| 382925 | 4/1987 | Germany | 49/27 |

*Primary Examiner*—Brian K. Green
*Assistant Examiner*—Curtis A. Cohen
*Attorney, Agent, or Firm*—Lathrop & Clark

[57] ABSTRACT

An automatic door assembly has a closure or door which is driven across a portal by an operator with automatic control. An extruded plastic retainer strip is screwed to the leading edge of the door. The retainer has two inwardly angled tabs which engage with a safety edge gasket assembly in snap-fit relation. The gasket assembly has an extruded resilient plastic gasket assembly with two legs which are engaged within a generally rigid extruded PVC base. A pneumatic sensing tube is supported on a single rib within the gasket assembly. The tube is connected to a conventional treadle sensor which has a switch responsive to deflection of a diaphragm to signal the door controller to reverse direction of the door when an obstacle is encountered by deflection of the gasket and the attached sensing tube. The safety edge assembly when used with bi-part or overhead doors also serves as a gasket to prevent air or other infiltration past the closure.

8 Claims, 3 Drawing Sheets

COMBINATION DOOR GASKET AND SAFETY EDGE STRIP

FIELD OF THE INVENTION

The present invention relates to automatic doors in general, and to apparatus for detecting interference with an automatically closing door in particular.

BACKGROUND OF THE INVENTION

Automatic doors are used extensively in commercial, industrial and residential applications, where it is desired to provide a portal which can be covered and uncovered in a hands-free manner. In most instances, however, it is important that the opening be closed immediately after a person has passed through the portal, to prevent entrance of debris and further to retain environmental differences between the interior and exterior regions. Walk-in freezers, for example, are equipped with automatic doors to allow a person encumbered with parcels or pushing a load truck to easily enter, while at the same time minimizing the time during which the cool interior air may escape.

Doors which close automatically after a preset time present the possibility that an object or person may still be crossing the threshold when the doors begin to close. It is undesirable to strike a person passing through the portal, and it is also detrimental to the door mechanism to be driven against an obstacle toward a closed position. Hence, doors are provided with safety attachments which detect the presence of a person or obstacle in the door path, and reverse the direction of the door upon encountering abnormal resistance or being subjected to a force in a direction counter to the direction of closure. In many applications some such detector is required by law.

One type of safety edge utilizes a pneumatic signal tube which is enclosed within a flexible covering and which is supported within the tube by foam strips. Compression of the foam to such an extent that the tube is deflected causes a switch to be thrown which in turn reverses the motion of the door.

Another type of safety edge has a flexible edge strip which supports two conductive plates in space relation. Compression of the edge strip causes contact between the two plates, and hence reversal of door motion. In a variation on this approach, the edge strip itself may be made electrically conductive, and a conductive rib may extend within the strip to make contact with the strip when an obstacle is encountered.

Other doors use photo-electric sensors which detect blockage of the passage along the edge strip.

What is needed is a sensitive safety edge which is at the same time low cost and simple to install, and which when used with hi-part or overhead doors may also serve as a gasket or weather strip.

SUMMARY OF THE INVENTION

The automatic door assembly of this invention has a closure which is moved across a portal by an operator with automatic control. An extruded plastic retainer strip is screwed to the leading edge of the door. The retainer has two inwardly angled tabs which engage with a gasket assembly in snap-fit relation. The gasket assembly has an extruded resilient plastic gasket assembly with two legs which are engaged within a generally rigid extruded PVC base. A pneumatic sensing tube is supported on a single fib within the gasket assembly. The tube is connected to a conventional treadle sensor which has a switch responsive to deflection of a diaphragm to signal the door controller to reverse direction of the door when an obstacle is encountered by deflection of the gasket and the attached sensing tube. The safety edge assembly when used with bi-part or overhead doors also serves as a gasket to prevent air or other infiltration past the closure.

It is an object of the present invention to provide a safety edge for an automatic door assembly which may be snapped into place.

It is a further object of the present invention to provide a safety edge for an automatic door assembly which is sensitive to light impact by a person standing in the way of the closing door.

It is an additional object of the present invention to provide a safety edge for an automatic door assembly which is easily replaced.

It is another object of the present invention to provide a safety edge for an automatic door which also serves as a sealing gasket.

It also an object of the present invention to provide a safety edge for an automatic door which is of economical construction.

Further objects, features and advantages of the invention will be apparent from the following detailed description when taken in conjunction with the accompanying drawings.

DESCRIPTION OF THE PREFERRED EMBODIMENT

Figure 1:
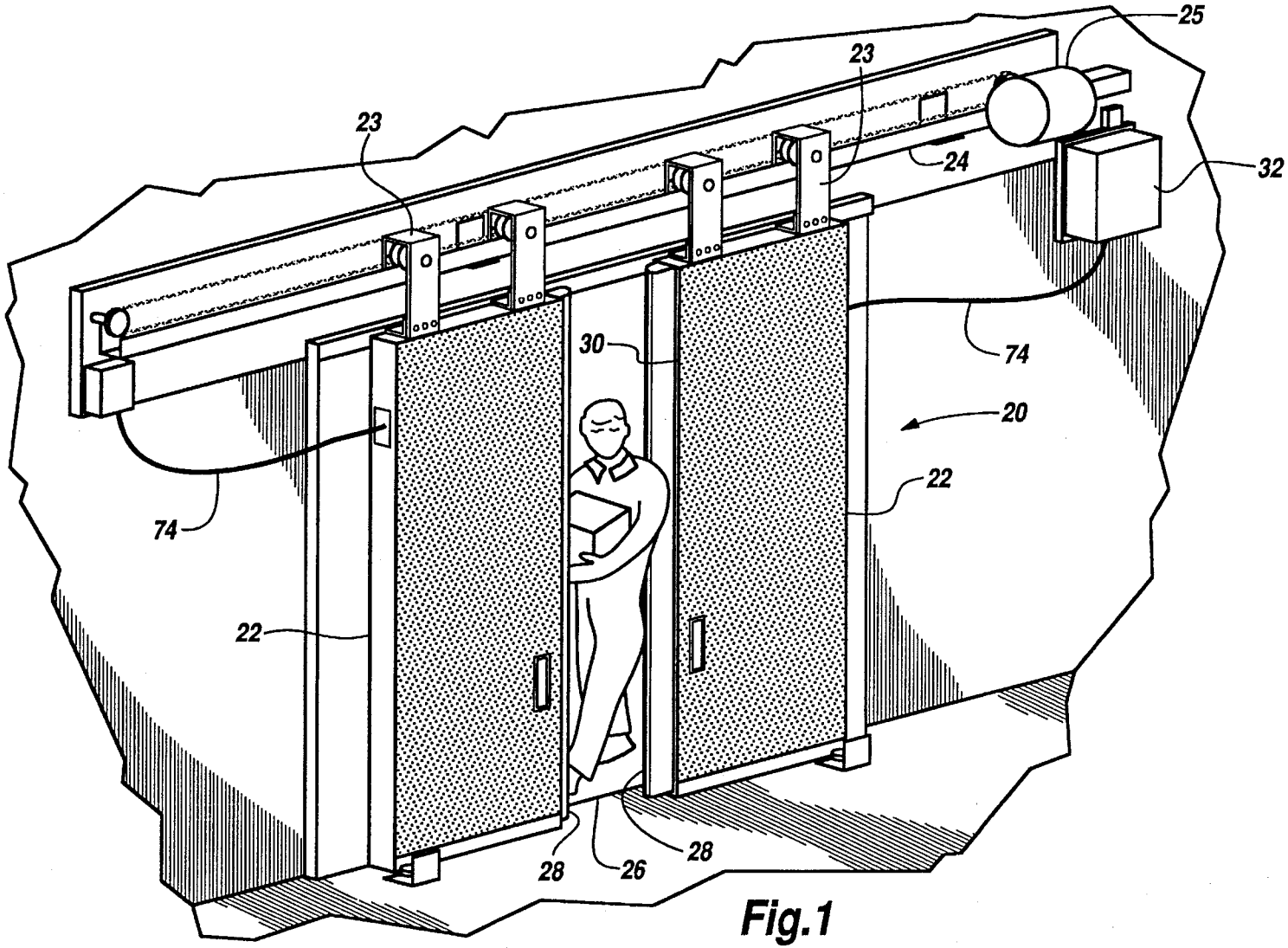
FIG. 1 is a schematic view of exemplary bi-part doors equipped with the safety edge of this invention and detecting a person in the path of the closing doors.
Figure 2:
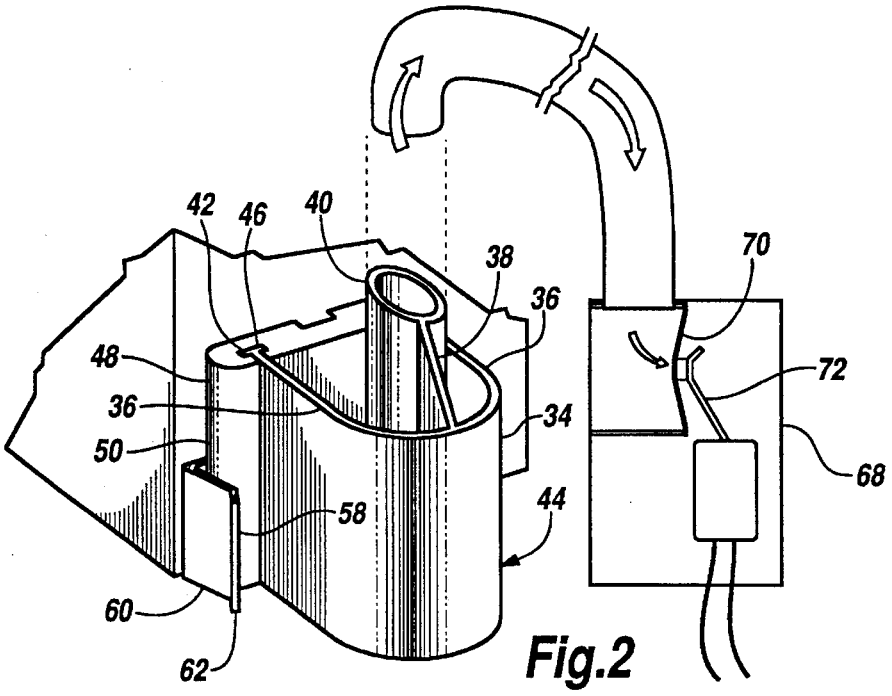
FIG. 2 is a fragmentary view of the leading edge of a door of this invention, with the pneumatic signal detector shown schematically.

Referring more particularly to FIGS. 1–6, wherein like numbers refer to similar parts, an automatic bi-part door assembly 20 is shown in FIG. 1. The assembly 20 has two sliding closures or doors 22 which are mounted on hangers 23 which run on overhead rails 26. The doors 22 are driven by an electric motor 25 to close a portal 24 by bringing the doors together, and to open the portal by separating the doors. The portal 24 may be, for example, the entrance to a walk-in freezer. A safety edge assembly 28 is mounted to the leading edge 30 of each door 22. The doors 22 are caused to open and close by an electronic controller 32, which may be connected to an infrared or pressure sensor to detect the approach of a person. The controller 32 will typically employ a time delay of a preset value to determine when to close the doors 22 once they have been opened. However, on occasion, a person or an object will still be present in the path of the doors 22 when the controller causes the doors to close. The safety edge assemblies 28, shown in FIG. 2, serve to detect the presence of an obstacle, and to send a signal to the controller 32 to reverse the direction of the doors 22.

Figure 3:
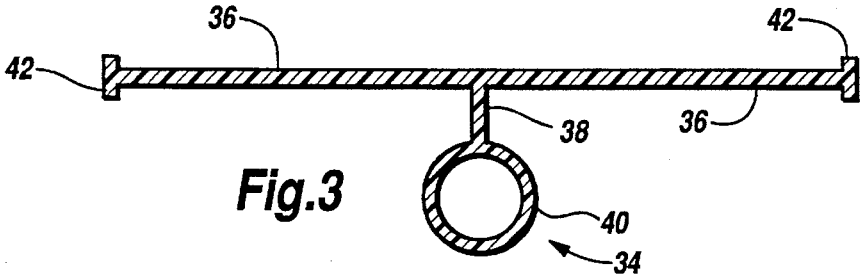
FIG. 3 is a cross-sectional view of the signal tube and gasket extrusion of the safety edge of this invention.

As shown in FIG. 3, each safety edge assembly 28 has an extruded gasket 34, formed of a resilient plastic material, for example, 70 Durometer PVC, with UV protection, and preferably resistant to oils and chemical corrosion, of the type which may be manufactured by The Sperry Rubber & Plastics Co., Inc., of Brookville, Ind. The gasket 34 is preferably extruded from a safety yellow plastic, to brightly indicate the leading edges of the moving doors 22. For applications involving freezers, the plastic should be specified for acceptable performance down to −20 degrees Fahrenheit. The gasket 34 not only serves as a seal, but is also the sensing edge of the safety edge assembly 28. The gasket 34 has two legs 36 which extend sidewardly from a central rib 38 which supports an axially extending cylindrical signal tube 40. Each gasket leg 36 has a narrow tongue 42 which extends perpendicularly to the leg.

Figure 4:
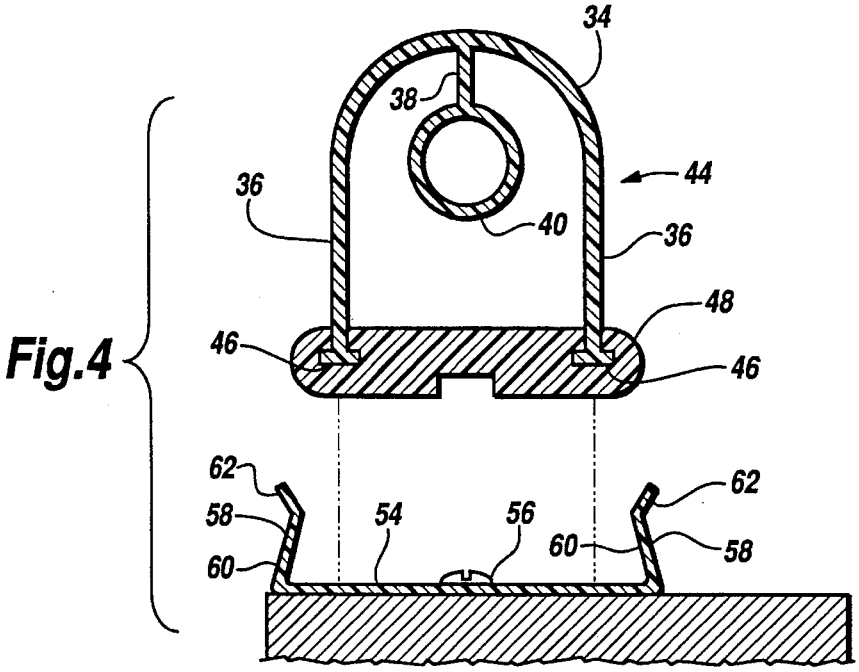
FIG. 4 is a partially exploded cross-sectional view of the assembly of the extrusion of FIG. 3 into a gasket retainer fastened to the leading edge of an automatic door.
Figure 5:
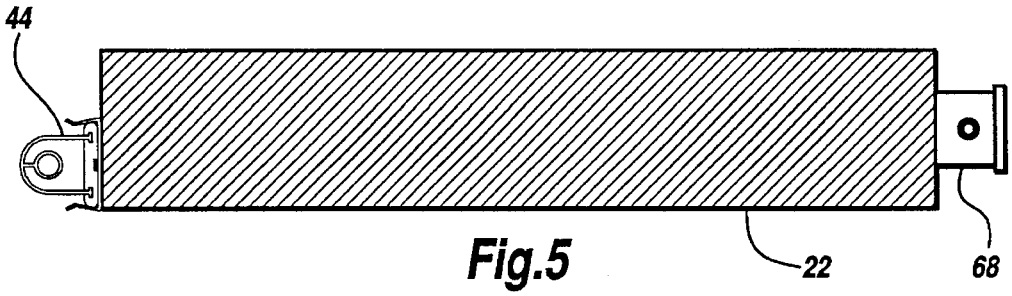
FIG. 5 is a cross-sectional view, taken along section line 5—5 of the door assembly of FIG. 6.

A gasket assembly 44 is formed, as shown in FIG. 4, by folding the two gasket legs 36 together and inserting the tongues 42 into two parallel inverted T-shaped grooves 46 which are formed in an extruded PVC plastic gasket base 48. The tongues 42 have a close fit with the grooves 46, and assembly may be aided by applying a silicone lubricating spray to the base 48 before inserting the gasket 34. The base 48 is a rigid PVC unit which has rounded sides 50 which facilitate the engagement of the gasket assembly in a snap-fit relation with a gasket retainer 52 which is fixed to the leading edge 30 of a door 22.

The assembled gasket 34 supports the signal tube 40 on a curved flexible plastic arch formed by the bent legs 36. In a preferred embodiment the signal tube 40 has an internal diameter of about0.75 inches, and a wall thickness of about 0.08 inches. The rib is preferably about one quarter inch long.

The gasket retainer 52 is a PVC plastic extrusion which has an attachment surface 54 which is generally planar and which is positioned against the door leading edge 30. The gasket retainer provides a means for retaining the gasket assembly on the leading edge of the door 22. The retainer 52 is preferably connected to the door leading edge 30 by first applying a bead of silicone caulk along the leading edge, and then fastening the retainer 52 to the door over the bead with fasteners 56, for example #8×¾ TEK. pan head screws. For ease of installation, the retainer 52 may be extruded with a low relief marking line (not shown) which extends along the center of the attachment surface 54 and provides guidance for installation of the fasteners 56.

The retainer 52 has two deflectable tabs 58 which extend from the attachment surface 54 away from the door leading edge. Each tab 58 has an inwardly inclined segment 60 which extends from the attachment surface 54, and a shorter outwardly inclined segment 62 which extends from the inwardly inclined segment. The gasket assembly 44 is thus easily connected to the door 22 by pressing the base 48 into the gasket retainer 52. The rounded sides 50 of the gasket assembly base 48 engage against the outwardly inclined segments 62 of the retainer 52 causing the tabs 58 to flex outwardly. Once past the outwardly inclined segments 62, the base is retained by the inwardly inclined segments 60 and the gasket assembly is held in place.

The base 48 has an axially extending slot 64 which overlies and provides clearance for the fasteners 56 which connect the retainer 52 to the door 22.

Figure 6:
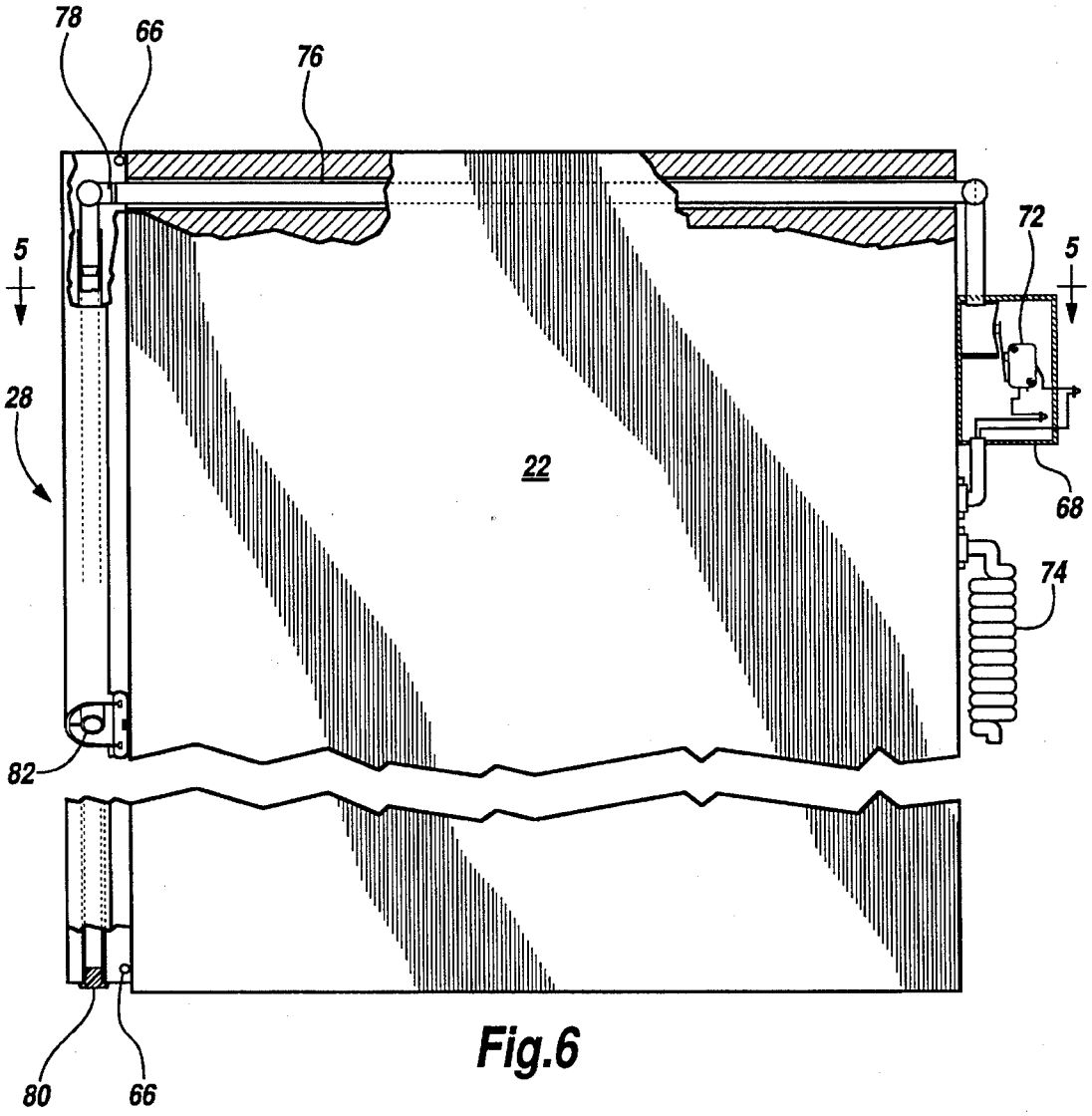
FIG. 6 is a side elevational view, partially broken away in section, of one door of the door assembly of FIG. 1.

As shown in FIG. 6, the gasket assembly 48 is fixed in place within the retainer 52 by two fasteners 66, for example #8×¾ TEK screws, which extend through a tab 58 and one leg 36 of the gasket 34 at the foot and at the head of the door 22.

To remove the gasket assembly 48 from the door 22, the fasteners 66 are removed and the gasket assembly 48 is popped out of the retainer 52. In this way service is simplified.

Mounted to the door 22 is a pneumatic switch box 68, such as the one supplied with the pneumatic treadle control kit, Part No. 65-8206, available from Link Controls, 2111 Lakeland Avenue, Konkonkoma, N.Y. 117799. The switch box 68 performs as a sensor for air discharges from the tube 40, and has a diaphragm 70 which responds to air pressure by activating a switch 72 which is in electrical connection with the controller 32. The electrical connection is made through a coiled cable 74, shown in FIGS. 1 and 6.

A pneumatic hose 76, as shown in FIG. 6, extends from the gasket assembly 48 to the switch box 68. The signal tube 40 is cut away to be accessible to the pneumatic hose 76, and is connected thereto by a right-angle hose connector 78. A solid plug 80 is inserted in the signal tube 40 at the end opposite the pneumatic hose connection, to thereby form a sealed air cavity 82 between the plug 80 and the switch box diaphragm 70. Any significant change in the volume of the sealed air cavity will cause a rush of air against the diaphragm 80 which will actuate the switch 72 and cause the reversal of the door's travel.

A deflection of as little as one quarter of an inch in the gasket 34 will be sufficient to actuate the switch 72. The rib 38 is a long thin member which will respond to even a minor deflection of the outer surface of the gasket 34 by introducing a kink or bend into the signal tube 40 which will send a puff of air to activate the switch 72.

It should be noted that although the safety edge assembly has been illustrated in use with hi-part doors, it may also be used on other types of moveable closures, including overhead doors, or a single sliding door. The safety edge may also be employed in sliding gate applications.

It is understood that the invention is not limited to the particular construction and arrangement of parts herein illustrated and described, but embraces such modified forms thereof as come within the scope of the following claims.

I claim:

1. An automatic door assembly comprising:

a) a door which has a leading edge, wherein the door is movable between a position which obstructs a portal and a position which allows access to said portal;

b) means for moving the door between a position allowing access to the portal and a position obstructing the portal;

c) a retaining member mounted on the leading edge of the door;

d) a base releasably mounted on said retaining member;

e) an extruded flexible gasket forming an arch with two legs which are releasably mounted to a receiving means in the base, the legs enclosing a rib extruded with the gasket, the rib extending towards the base and terminating in a coformed signal tube, the tube enclosed between the arch and the base;

f) the signal tube being deformed against the base and engaged thereto when the arch of the gasket is formed and wherein the tube discharges air when deformed;

g) a sensor for detecting air discharged from the signal tube; and h) a controller which is connected to the sensor, wherein the controller reverses the motion of the closure upon detection of air discharged from the signal tube.

2. The automatic door assembly of claim 1 wherein the receiving means comprises a retainer strip connected to said door leading edge and having tabs which extend away from the leading edge; and the gasket base is engaged with the retainer strip in a snap-fit relation.

3. An automatic door assembly comprising:

a) a closure which has a leading edge, wherein the closure is movable between a position which obstructs a portal and a position which allows access to said portal;

b) means for moving the closure between a position allowing access to the portal and a position obstructing the portal;

c) a flexible gasket which extends along the closure leading edge, wherein the gasket has a wall which protrudes from the leading edge and which defines a gasket interior between the leading edge and the gasket;

d) a rib which is integrally formed with the gasket and which extends toward the closure leading edge;

e) a signal tube which is positioned within the gasket interior and which is integrally formed with the rib and connected along the length of the rib, and thereby spaced from the leading edge in an undeflected condition, wherein deflection of a portion of the gasket causes a deflection of the signal tube, f) means for retaining the gasket assembly on the leading edge of the closure, wherein the means for retaining the gasket assembly on the leading edge comprises a retainer strip connected to said closure leading edge and having tabs which extend away from the leading edge, and a gasket base engaged with the gasket and engaged with the retainer strip in a snap-fit relation, wherein each tab has a first portion which is inclined inwardly toward the other tab, and a second portion extending from the first portion which is inclined outwardly away from the other tab, and wherein the base has rounded edges which are engaged between the tab first portions;

g) a sensor for detecting air discharged from the signal tube; and a controller which is connected to the sensor, wherein the controller reverses the motion of the closure upon detection of air discharged from the signal tube.

4. An automatic closure safety edge assembly attached to a leading edge of a movable door, comprising:

a) a retaining means mounted on the leading edge of the door;

b) a base removably mounted to the retaining means along the leading edge of a door;

c) an extruded flexible gasket forming an arch having a first flexible leg, a second flexible leg, and a rib which extends toward the base from between the first leg and the second leg, the rib terminating in an extruded signal tube, wherein the first leg and the second leg are connected to a receiving means within the base; and d) the tube is formed with the rib and positioned between the first leg and the second leg by the rib, and wherein deflection of the flexible gasket arch causes a deformation of the tube and produces thereby a discharge of air from the tube, such that an obstacle placed in the path of the door will impact the gasket and cause a discharge of air which is detectable by a door reversing circuit.

5. The closure safety edge assembly of claim 4 wherein the retaining means comprises a retainer which is connectable by fasteners to the door leading edge, wherein the retainer has two tabs which extend away from the leading ledge and which extend on either side of the base, and thereby retain the base and the attached gasket on the closure.

6. An automatic closure safety edge assembly for attachment to the leading edge of a movable closure, the safety edge assembly comprising:

a) a base which is connectable to the leading edge of a movable closure;

b) a flexible gasket having a first flexible leg, a second flexible leg, and a rib which extends toward the base from between the first leg and the second leg, wherein the first leg and the second leg are connected to the base;

c) a retainer which is connectable by fasteners to the closure leading edge, wherein the retainer has two tabs which extend away from the leading ledge and which extend on either side of the base, and thereby retain the base and the attached gasket on the closure, wherein each tab has a first portion which is inclined inwardly toward the other tab, and a second portion extending from the first portion which is inclined outwardly away from the other tab, and wherein the base has rounded edges which are engaged between the tab first portions; and c) a tube connected to the rib and positioned between the first leg and the second leg by the rib, and wherein deflection of the flexible gasket causes a deformation of the tube and produces thereby a discharge of air from the tube, such that an obstacle placed in the path of the safety edge will impact the gasket and cause a discharge of air which is detectable by a closure reversing circuit.

7. An automatic closure safety edge assembly for attachment to the leading edge of a movable closure, the safety edge assembly comprising:

a) an extrude plastic retainer having a positioning surface for attachment to the door leading edge, and two tabs which extend from the positioning surface away from the leading edge;

b) an extruded plastic base have two spaced parallel grooves formed therein, wherein the base engages in snap-fit relation with the retainer between the two tabs;

b) a flexible gasket having a first flexible leg, a second flexible leg, and a rib which extends toward the base from between the first leg and the second leg, wherein the first leg and the second leg have tongues which engage with the base grooves, the gasket legs thereby forming a curved surface which protrudes from the leading edge of the closure; and c) a tube connected to the rib, wherein the tube is positioned between the first leg and the second leg by the rib, and wherein deflection of the flexible gasket causes a deformation of the tube and produces thereby a discharge of air from the tube, such that an obstacle placed in the path of the safety edge wilt impact the gasket and cause a discharge of air which is detectable by a door reversing circuit.

8. The automatic closure safety edge assembly of claim 7 wherein each tab has a first portion which is inclined inwardly toward the other tab, and a second portion extending from the first portion which is inclined outwardly away from the other tab, and wherein the base has rounded edges which are engaged between the tab first portions.

* * * * *